United States Patent [19]

Roarty

[11] Patent Number: 4,736,713

[45] Date of Patent: Apr. 12, 1988

[54] FORAMINOUS OR PERFORATED FLOW DISTRIBUTION PLATE

[75] Inventor: Joseph D. Roarty, Pleasant Hills, Pa.

[73] Assignee: Westinghouse Electric Corp., Pittsburgh, Pa.

[21] Appl. No.: 915,934

[22] Filed: Oct. 6, 1986

Related U.S. Application Data

[63] Continuation of Ser. No. 671,822, Nov. 15, 1984, abandoned.

[51] Int. Cl.[4] ..... F22B 1/16

[52] U.S. Cl. ..... 122/32; 122/235 F; 165/160

[58] Field of Search ..... 122/32, 235 F, 438, 122/511, 512; 165/159, 160; 210/175, 251

[56] References Cited

U.S. PATENT DOCUMENTS

| | | | |
|---|---|---|---|
| 1,988,659 | 1/1935 | LaMont . | |
| 2,316,765 | 4/1943 | Hobbs . | |
| 3,076,444 | 2/1963 | Bell | 122/34 |
| 3,308,878 | 3/1967 | Durst et al. | 122/32 |
| 3,450,199 | 6/1969 | Warrell | 165/159 |
| 3,451,472 | 6/1969 | Keck | 165/134 |
| 3,519,024 | 7/1970 | Johnson et al. . | |
| 3,559,625 | 2/1971 | Koshelev et al. . | |
| 3,610,538 | 10/1971 | Enders . | |
| 3,623,505 | 11/1971 | Barsness et al. . | |
| 3,706,534 | 12/1972 | Verheul et al. . | |
| 3,841,272 | 10/1974 | Mayer et al. | 165/159 X |
| 3,877,895 | 4/1975 | Wonderland et al. | 55/97 |
| 3,911,067 | 10/1975 | Chen et al. | 261/113 |
| 3,915,123 | 10/1975 | Reisacher | 165/160 X |
| 3,916,844 | 11/1975 | Cassell | 122/32 |
| 3,923,007 | 12/1975 | Schroder | 122/32 |
| 4,205,632 | 6/1980 | Tratz | 122/34 |
| 4,300,481 | 11/1981 | Fisk | 122/406 B |
| 4,308,914 | 1/1982 | Ruhe et al. | 165/160 |
| 4,334,554 | 6/1982 | Geiger et al. | 122/406 B X |
| 4,357,908 | 11/1982 | Yazidjian | 122/32 |
| 4,579,088 | 4/1986 | Kim, Jr. et al. | 165/159 X |

FOREIGN PATENT DOCUMENTS

| | | |
|---|---|---|
| 0035450 | 9/1981 | European Pat. Off. . |
| 2720812 | 3/1978 | Fed. Rep. of Germany . |
| 2182119 | 12/1973 | France . |
| 2458781 | 1/1981 | France . |
| 1407137 | 9/1975 | United Kingdom . |

*Primary Examiner*—Steven E. Warner
*Attorney, Agent, or Firm*—D. C. Abeles

[57] ABSTRACT

In a steam generator, there is provided an annular foraminous or perforated flow distribution plate (100) which may be in the form of a single-piece annulus fixedly secured to the lower end of the heat exchange tube wrapper (146) for installation within new steam generator facilities, or alternatively, may comprise a plurality of arcuately-shaped segments (210) secured together by suitable bolt fasteners (226) for installation within existing steam generator facilities. The plate (100) is adapted to be wedgingly interposed between the lower end of the tube wrapper (146) and the upper surface (204) of the heat exchange tube bundle tubesheet (122), and the plate (100) has the configuration of a conical frustum for stability. The foraminous plate (100) serves to impart uniform, non-turbulent, flow conditions to the infeed water (206) flowing downwardly through the downcomer region (148) of the generator, defined between the generator outer shell (116) and the tube wrapper (146), and passing through the transition region (216) of the generator for entrance into the tube bundle section (208) of the generator. In addition, the predetermined size of the apertures (212) defined within the plate (100) prevents the entrance of foreign particles into the tube bundle section (208) of the generator having, for example, a diametrical size greater than the predetermined size of the plate apertures (212). The plate (100) is fabricated from INCONEL 60 nickel-chromium alloy for good service life characteristics.

17 Claims, 2 Drawing Sheets

FORAMINOUS OR PERFORATED FLOW DISTRIBUTION PLATE

This application is a continuation of application Ser. No. 671,822 filed Nov. 15, 1984 now abandoned.

BACKGROUND OF THE INVENTION

1. Field of the Invention

The present invention relates generally to nuclear reactor steam generators, and more particularly to a perforated flow distribution plate operatively connected to the lower end of the steam generator tube wrapper for effectively minimizing turbulent flow conditions conventionally exhibited within the water, which traverses the region of the steam generator defined beneath the lower end of the steam generator tube wrapper, as the water flows from the lower end of the downcomer region of the steam generator, the downcomer region being defined between the steam generator shell and the steam generator tube wrapper, into the interior portion of the steam generator tube wrapper. Uniform flow conditions, free of conventionally generated or induced vortices, are thus imparted to the water flowing through the aforenoted steam generator regions, and particularly within the interior portion of the steam generator tube wrapper, whereby excessive vibrational motion and movement of the steam generator heat exchanger tube bundle tubes, which phenomena could possibly lead to tube wear, erosion, structural fatigue, stress cracking, and the like, is effectively precluded. In addition, foreign objects, having a predetermined size, are effectively prevented from entering the tube bundle section of the steam generator heat exchanger so as not to similarly cause degradation of the steam generator heat exchanger tube bundle tubes as a result of conventional erosive impaction or impingement of such foreign particles upon the tubes.

2. Description of the Prior Art

A nuclear reactor produces heat as a result of the fission of nuclear material which is disposed within fuel rods, and the fuel rods are secured together in predetermined arrays so as to define fuel assemblies. The fuel assemblies, in turn, define the nuclear reactor core, and the core is disposed within a reactor or pressure vessel. In commercial nuclear reactor facilities, the heat produced by means of the aforenoted fission processes is utilized to generate electricity. In particular, a conventional facility may comprise, for example, a primary coolant flow and heat exchange or transfer loop to which conventional steam generators and steam turbines, as well as electrical generators, are fluidically and mechanically connected, respectively. A typical energy conversion process for such commercial nuclear reactor facilities would therefore comprise, for example, the transfer of heat from the nuclear core to the primary coolant flow and loop system, and from the primary coolant flow and loop system to the steam generators by means of suitable heat exchangers incorporated within the steam generators. The steam generated within the steam generators is then of course transmitted to the steam turbines to which the electrical generators are operatively connected, and from which electricity is ultimately generated.

With reference initially being made to FIG. 1 of the drawings, a conventional steam generator structure or facility is disclosed. In particular, the steam generator is seen to comprise a vertically oriented, elongated entity which includes a hollow, substantially cylindrical shell 12 having an upper shell section 14, a lower shell section 16, and a transition zone section 18 integrally interconnecting together the upper and lower shell sections 14 and 16. The diametrical extent of the upper shell section 14 is greater than that of the lower shell section 16, and consequently, the transition zone section 18 has the configuration of a conical frustrum. A multitude of steam generator heat exchanger tubes 20 extend vertically within the central portion of the lower shell section 16 of the steam generator so as to define together a tube bundle. The uppermost portion of each of the tubes 20 extends upwardly within the transition cone section 18 of the steam generator and is seen to have an inverted Ushaped configuration. In this manner, the lower extremities of each tube 20 can be fixedly secured within a tube sheet 22 disposed within the lower end of the lower shell section 16. Integrally formed or secured to the outer periphery of the lower end of the lower shell section 16 within virtually the same horizontal plane as that of the tube sheet 22 is an annular support ring 24 by means of which the entire steam generator structure is capable of being supported upon the nuclear reactor facility or plant foundation. The lowermost end of the steam generator lower shell section 16 is sealingly enclosed by means of a hemispherically shaped shell portion 26, and disposed within hemispherical shell 26 is a vertically oriented divider plate 28 which serves to divide hemispherical shell 26 into two spherical quadrants. As may readily be appreciated, each of the quadrants is fluidically connected to one of the extremities of each of the heat exchanger tubes 20, and each quadrant is also provided with a fluid nozzle 30 and 32, respectively, which serve to introduce nuclear reactor core coolant into, and discharge nuclear reactor core coolant from, the steam generator. In this manner, during operation of the nuclear facility, primary core coolant is conducted throughout its heat exchange or transfer loop from the nuclear reactor core, not shown, through inlet nozzle 30, the left steam generator hemispherical shell quadrant 34, the steam generator tube bundle U-shaped heat exchanger tubes 20, the right steam generator hemispherical shell quadrant 36, as viewed in FIG. 1, outlet nozzle 32, and back to the nuclear reactor core.

In order to provide for the generation of steam within the steam generator, an inlet feedwater nozzle 38 is provided within a sidewall portion of the upper shell section 14 of the steam generator, and a water conduit 40 is disposed internally of nozzle 38. The conduit 40 is integrally connected with an annular manifold 42 which has operatively associated, in a fluidically connected manner, a multitude of upstanding, inverted J-tubes or nozzles 44 through means of which the incoming feedwater is projected downwardly in cascading sheets. In order to define a flowpath for the cascading water flowing downwardly through the steam generator, the entire tube bundle is enveloped or encased within a cylindrical tube wrapper 46 which extends vertically, and substantially concentrically, within the lower and transitional zone sections 16 and 18 of the steam generator shell 12, the tube wrapper 46 being rigidly secured within the shell 12 by suitable means, not shown. In this manner, the tube wrapper 46 and the lower and transitional zone sections 16 and 18 of the shell 12 serve to define an annular downcomer region 48 through which the water flows downwardly toward the bottom of the steam generator facility. It is seen that the lower peripheral edge of the tube wrapper 46 is suspended above the upper surface of the tube sheet 22 whereby a transverse flow region is defined between the downcomer region 48 of the generator and the tube bundle section of the generator which is disposed interiorly of the tube wrapper 46. The water therefore enters the tube bundle section of the generator, and the heat exchange process between the water and the heated tube bundle tubes 20, through which the hot reactor core coolant is being conducted and circulated, begins to take place with the water passing between all of the heat exchange tubes 20. As a result, steam is generated, and the water and steam flow upwardly through the entire tube bundle, between the tubes 20, under natural convection. In order to provide lateral support and stabilization for the heat exchange tubes 20 throughout their vertical extent, a plurality of horizontally disposed, vertically spaced tube support plates 50 are fixedly secured to the interior wall surface of the tube wrapper 46. As is conventional, the heat exchanger tubes 20 pass through holes or apertures 52 defined within the tube support plates 50, there being sufficient spatial clearance defined between the tubes 20 and the plate apertures or holes 52 so as to provide for the desired, limited lateral support and restricted movement of the tubes 20, in response to the water flow thereabout as well as thermal expansion and contraction conditions, without hindering the passage therethrough of the water and steam flowing upwardly through the generator. It is to be further noted that in view of the U-shaped configuration of the tubes 20, a tube passageway or lane 54 is defined between the legs of the tubes 20, and within each of the horizontally disposed support plates 50, with the exception of the lowermost plate 50', there are defined a plurality of radially aligned slots 56 through which water and steam may likewise pass from one vertically spaced or defined section of the generator heat exchanger portion to another. The lowermost support plate 50' has the configuration of an annular disc with the central portion thereof open, and in this manner, the plate 50' serves as a flow distribution baffle which effectively causes a high percentage of the incoming water to flow from the radially outer portion of the tube bundle section of the steam generator, beneath the undersurface of the plate or baffle 50', and upwardly through the large central aperture defined within the plate or baffle 50', with the remaining portion of the incoming water flow passing upwardly through the apertures or holes 52 defined within plate or baffle 50'. Water and steam can therefore flow upwardly through the various vertically spaoed stages of the heat exchanger, through means of the holes or apertures 52, as well as the slots 56 and the lanes 54, in a predeterminedly defined pattern which seeks to achieve flow uniformity. In addition to the support plates 50, antivibration bars 58 may be provided within the uppermost portion of the wrapper 46 so as to engage the uppermost, U-shaped bent sections of the heat exchanger tubes 20 for likewise performing restrictive and stabilizing functions with respect to tubes 20 in a manner similar to that of support plates 50 under steam and water flow, as well as thermal expansion and contraction, conditions. As a result, excessive wear of the heat exchanger tubes 20 is effectively prevented or substantially reduced, as is vibrational noise.

The upper end of the steam generator heat exchanger tube wrapper 46 is integrally provided with a horizontally disposed deck or cover 60 so as to seal the interior of the wrapper 46 within which the heat exchanger U-bent tubes 20 are disposed, however, in order to permit the upward escape of the generated steam from the heat exchanger portion of the generator and out of the wrapper 46, a plurality of holes 62 are defined within the cover or deck 60. A plurality of upstanding swirl vane primary moisture separators 64, in the form of, for example, cylindrical tubes approxixately twenty inches (20") in diameter, are vertically supported atop tube wrapper deck or cover 60 with the lower ends thereof respectively in fluidic communication with the apertures or holes 62. A pair of horizontally disposed, vertically spaced lateral support plates 66 are fixedly secured with respect to the moisture separator tube systems at the upper ends and the axially central portions thereof, and in particular, it is seen that a plurality of apertures 68 are defined within the axially central or lower support plate 66 so as to permit the separator tubes 64 to pass therethrough. A plurality of outer cylindrical casings 70 concentrically surround those portions of the swirl vane separator tubes 64 which are disposed between the lateral support plates 66, and the upper ends of the casings 70 are in contact with the undersurface of the lower lateral support plate 66. Orifice bushings 72, having a diametrical extent which is less than that of the casings 70, are disposed within apertures 74 defined within the upper lateral support plate 66 such that the upper ends of the bushings 72 extend slightly above the upper surface of the upper support plate 66 while the lower ends of the bushings 72 are disposed within the upper ends of the casings 70. The upper ends of the swirl vane tubes 64 terminate at a level within the casings 70 which is below that of upper lateral support plate 66, and in this manner, water thrown radially outwardly under centrifugal force as a result of the passage of the steam/water mixture through the swirl vane separator tubes 64, and in particular past the swirl vane separators 76 respectively disposed within each tube 64, can collect upon the inner surface of each casing 70 while the steam can continue to travel axially upwardly so as to pass through the upper ends of the separator casings 70 and orifice bushings 72. The lower ends of the casings 70 are provided with rectangularly shaped cut-outs or apertures 78 so as to permit the aforenoted separated water to pass outwardly therethrough and over the peripheral edge of the lower lateral support plate 66 and be discharged back into the downcomer region 48 for recirculation back upwardly through the heat exchanger tube bundle within wrapper 46.

Within the uppermost section of the steam generator shell portion 14, there is defined a steam dome chamber 80 into which the steam exiting from the orifice bushings 72 enters, and within which there is disposed a plurality of stacked positive entrainment steam dryers 82. The dryers 82 have the configurations of cubes or rectangular parallelepipeds, and the upper surface of the upper dryer 82 is open so as to mate with a similarly configured cut-out or aperture 84 defined within a divider plate 86 disposed within the steam dome chamber 80. In this manner, the steam exiting from the orifice bushings 72 and passing into the steam dome chamber 80 is forced to enter the sidewalls of the dryers 82 before being further passed through dryer 82 and upwardly out of dryer opening 84 for discharge from the steam generator through means of an axially upstanding steam nozzle 88 disposed atop the steam generator. The dryers 82 serve to separate any remaining or residual water vapor entrained within the steam before the latter is conducted to the steam nozzle 88 for further passage to the steam turbines and electrical generators, not shown, and any such separated water is conducted vertically downwardly to a suitable pool or reservoir 89, defined within the central portion of the wrapper deck or cover 60, by means of an axially central drain pipe 90 dependently affixed to the floor 92 of the lower dryer 82. The lower end of pipe 90 is vertically spaced above wrapper deck or cover 60, and in this manner, the water collected within reservoir or pool 89 may ultimately flow radially outwardly over the wrapper deck or cover 60 so as to cascade downwardly into the annular downcomer region 48.

Having now generally described the heat exchange operation of a conventional or typical steam generator, it has been observed that when the infeed water flowing vertically downwardly within the steam generator annulus or downcomer region 48 defined between the lower outer shell section 16 and the heat exchange bundle tube wrapper 46 traverses the region defined beneath the lower free end of the wrapper 46 so as to commence the upward flow within the wrapper 46 and between the heat exchanger U-bent tubes 20, considerable turbulence within the flow may develop due to the generation of vortices within the fluid flow as a result of the fluid encountering the upper surface of the tubesheet 22 as well as the lower ends of the legs of the heat exchange tubes 20 affixed within the tubesheet 22 as the flow seeks to achieve the 180° reversal in flow directions as defined by means of the flow vertically downwardly within the downcomer region 48 and vertically upwardly interiorly of wrapper 46 and between heat exchanger tubes 20. Such turbulent flow conditions may result in excessive vibrational motion of the heat exchanger tubes 20 within wrapper 46 so as to lead to rapid wear and erosion of the same. In addition, it is likewise possible that entrainment of foreign particles within the fluid flow could cause rapid degradation of the tubes 20 as a result of impaction or impingement of the same upon the tubes 20 under high velocity turbulent flow conditions.

Accordingly, it is an object of the present invention to provide a new and improved nuclear reactor steam generator.

Another object of the present invention is to provide a new and improved nuclear reactor steam generator which overoomes certain cited characteristics associated with conventional steam generators.

Yet another object of the present invention is to provide a new and improved nuclear reactor steam generator wherein turbulent fluid flow conditions within the region defined beneath the lower free end of the heat exchanger tube bundle wrapper and fluidically interconnecting the downcomer region of the generator, defined between the generator shell and the generator tube bundle wrapper, with the tube bundle region interiorly of the tube bundle wrapper, are effectively eliminated.

Still another object of the present invention is to provide a new and improved nuclear reactor steam generator wherein low velocity uniform fluid flow conditions free of vortices are capable of being established within the U-bent heat exchanger tube bundle section of the generator defined within the steam generator wrapper.

Yet still another object of the present invention is to provide a new and improved nuclear reactor steam generator wherein turbulent fluid flow conditions are effectively prevented from being generated or established within the U-bent heat exchanger tube bundle section of the generator defined within the steam generator wrapper, and concomitantly, low velocity uniform fluid flow conditions free of vortices are in fact established within such U-bent heat exchanger tube bundle section of the generator defined within the steam generator wrapper, whereby excessive vibrational movement of the heat exchanger tubes, and the accompanying noise and erosive wear of the tubes, is effectively eliminated or prevented.

Still yet another object of the present invention is to provide a new and improved nuclear reactor steam generator wherein foreign particles entrained within the infeed water, provided for the generation of steam, are effectively prevented from entering the heat exchanger tube bundle section of the generator so as not to cause any substantial degradation of the heat exchanger U-bent tubes as a result of impaction or impingement thereon, the aforenoted foreign particles being of a predetermined size.

A further object of the present invention is to provide a new and improved nuclear reactor steam generator wherein the teachings of the present invention are applicable both to existing steam generator facilities as well as newly constructed steam generator facilities.

SUMMARY OF THE INVENTION

The foregoing and other objectives are achieved in accordance with the present invention through the provision of a steam generator vessel or facility which has incorporated therein a circumferential, foraminous or perforated plate operatively associated with the lower peripheral free edge portion of the steam generator wrapper, wherein the plate rests, or is supported upon, the upper surface of the heat exchanger tube bundle tube sheet. In this manner, the downcomer region of the steam generator, as defined between the steam generator outer shell and the heat exchanger tube bundle wrapper, is fluidically closed off or separated from the heat exchanger tube bundle section or region of the steam generator, defined interiorly of the heat exchanger tube bundle wrapper, by means of the circumferentially extending perforated plate whereby the incoming infeed water can only enter the heat exchanger tube bundle region of the generator from the downcomer region of the generator through means of the apertures defined within the circumferentially extending perforated plate. As a result of the disposition of the circumferentially extending perforated plate within the normal flow path of the incoming infeed water, turbulent flow conditions within the region of the steam generator disposed directly beneath the lower peripheral edge of the steam generator wrapper, and fluidically interconnecting the steam generator downcomer region with the steam generator heat exchanger tube bundle region, is effectively eliminated or prevented as a result of the incoming or feed water being forced to pass through the apertures uniformly defined within the circumferentially extending perforated plate. The infeed water enters the heat exchanger tube bundle region of the steam generator in a substantially horizontal direction only, and at a substantially reduced flow velocity as compared to the local flow velocities attendant the fluid flow exhibited when the perforated plate of the present invention is not employed, and consequently, there is no tendency for vortices to be developed or generated, or even re-established once the incoming or feed water has passed through the perforated plate and into the heat exchanger tube bundle section or region of the steam generator.

The foraminous or perforated plate of the present invention is provided with apertures having a diameter of approximately onequarter inch (0.25"), and in this manner, foreign particles which may be entrained within the incoming or feed water are effectively prevented from entering into the heat exchanger tube bundle section or region of the steam generator wherein such particles would ordinarily impart considerable wear and erosive damage to the heat exchanger U-bent tubes as a result of impaction and impingement. While particles having a diametrical extent of less than one-quarter inch would be permitted to pass through the perforated plate of the present invention and into the heat exchanger tube bundle region of the steam generator, such particles are not apt to cause any substantial degradation or erosive problems with respect to the heat exchanger U-shaped tubes, and in addition, the provision of the apertures having the diametrical extent of one-quarter inch preserves the desired fluid flow characteristics of the incoming or feed water through the perforated plate and into the heat exchanger tube bundle section of the steam generator. A trade-off or balancing of operational objectives is therefore achieved.

Applicability of the teachings of the present invention to newly constructed nuclear reactor or other steam generator facilities may be achieved by forming the circumferentially extending perforated plate integrally with the heat exchanger tube bundle wrapper such that the perforated plate defines the lower peripheral portion of the wrapper which would be in engagement with the upper surface of the heat exchanger tube bundle tube sheet. In connection with existing steam generator facilities, the circumferentially extending perforated plate of the present invention may be incorporated within the steam generator by cutting an aperture through the steam generator shell, and transporting individual circumferentially shaped plate segments or sections through such outer shell aperture. The circumferential plate segments or sections may be bolted or welded together interiorly of the steam generator shell and operatively affixed with, or mounted upon, the lower free peripheral edge portion of the steam generator tube bundle wrapper, the bolted or welded segments or sections being circumferentially translated around the entire generator facility until the last two plate segments or sections are to come into butt contact with each other whereby they may similarly be bolted or welded together thereby completing the perforated plate assembly. Within existing field facilities, the perforated plate of the present invention is not in fact fixed to the tube bundle wrapper by any mechanical fastening means, however, the perforated plate, which in its assembled condition has the configuration of a conical frustum and therefore considerable stability, may be wedged beneath the lower free peripheral edge of the tube bundle wrapper so as to be rigidly interposed between the peripheral edge of the wrapper and the upper surface of the heat exchanger tube bundle tube sheet.

In accordance with an alternative mode of installing the circumferential perforated plate of the present invention within the steam generator facility the segments may be lowered downwardly by cable from personnel access maintenance manways so as to pass through the downcomer annulus region of the steam generator. As with the previously described mode of installation of the circumferential perforated plate segments or sections, an access aperture or hole within the vicinity of the lower peripheral free edge portion of the tube bundle wrapper must be made within the steam generator outer shell so as to facilitate the in-situ welding or bolting operations necessary for securing together the circumferential perforated plate segments or sections. Regardless of which installation technique is employed, suitable means, not forming any part of the present invention, must of course be subsequently employed in order to close the aperture or hole formed within the steam generator outer shell so as to permit the shell to regain its structural integrity.

BRIEF DESCRIPTION OF THE DRAWINGS

Various other objectives, features, and attendant advantages of the present invention will be more fully appreciated as the same becomes better understood from the following detailed description when considered in connection with the accompanying drawings, in which like reference characters designate like or corresponding parts throughout the several views, and wherein.

DESCRIPTION OF THE PREFERRED EMBODIMENT

Figure 1:
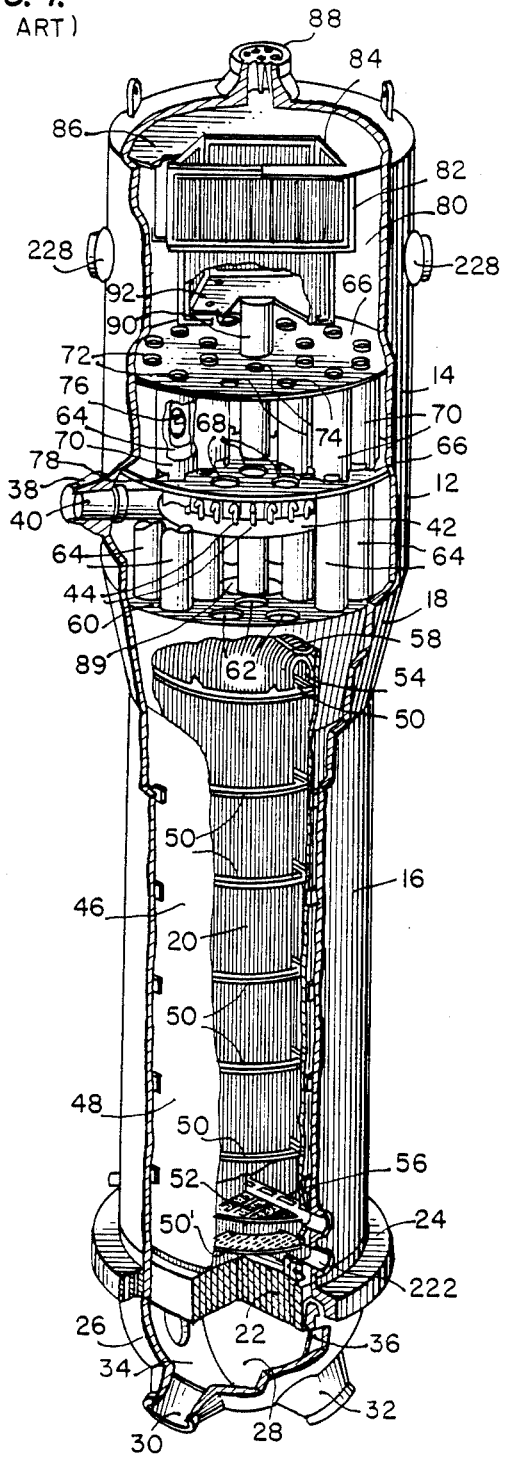
FIG. 1. (PRIOR ART)
FIG. 1 is a perspective view of a conventional nuclear reactor steam generator showing the cooperative parts thereof.
Figure 2:
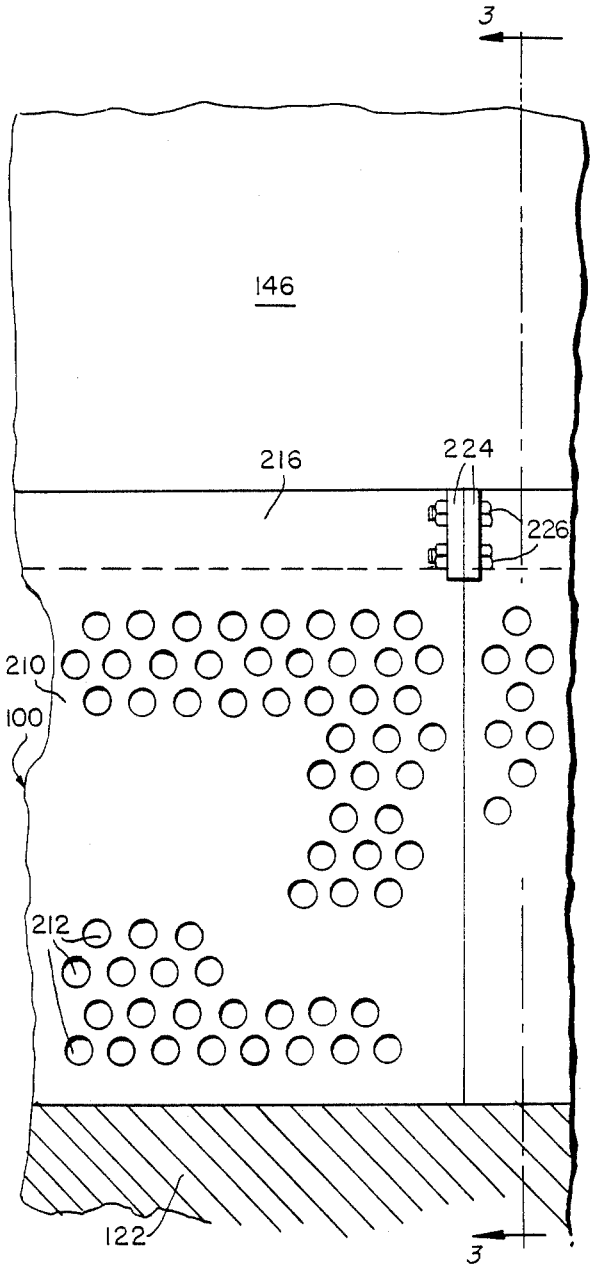
FIG. 2 is a front elevation view of the new and improved foraminous or perforated flow distribution plate constructed in accordance with the present invention and illustrated as being installed within, for example, a steam generator facility such as that illustrated within FIG. 1, and mounted in operative relationship with respect to the steam generator tube bundle wrapper and tube sheet.
Figure 3:
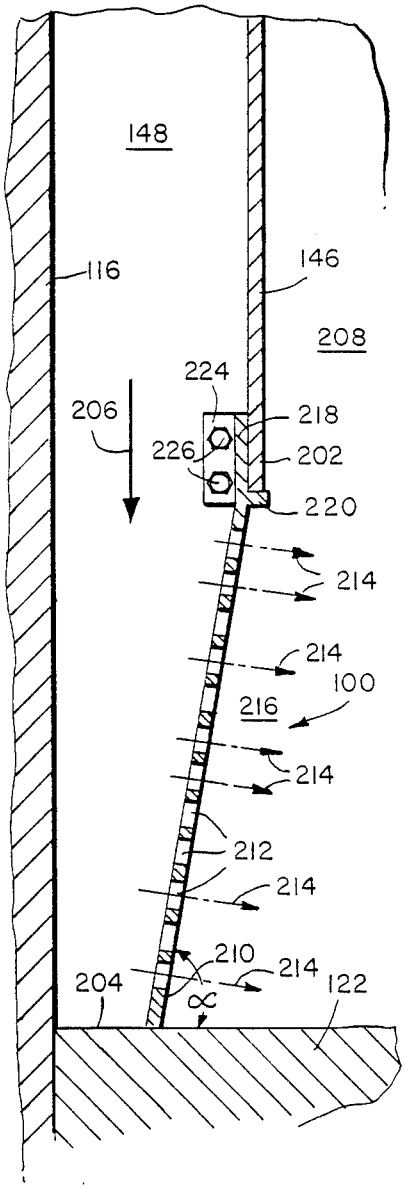
FIG. 3 is a vertical cross-sectional view of the new and improved perforated flow distribution plate illustrated in FIG. 2 and taken along the lines 3—3 of FIG. 2.

Referring again to the drawings, but with particular reference now being made to FIGS. 2 and 3 thereof, there is illustrated the new and improved foraminous perforated flow distribution plate constructed in accordance with the present invention and generally indicated by the reference character 100. It is to be appreciated that the perforated flow distribution plate 100 of the present invention comprises an annulus disposed circumferentially about the entire interior portion of the steam generator although, of course, only a limited section of the plate 100 is illustrated. As particularly seen from the drawing figures, the perforated plate 100 has the form of a conical frustum and is, in effect, a perimetrical skirt adapted to be interposed between the lower free edge portion 202 of the annular steam generator heat exchanger tube bundle wrapper 146 and the upper surface 204 of the tube bundle tube sheet 122. It is to be noted at this juncture that the reference characters denoting, for example, the various components of the steam generator system illustrated within FIGS. 2 and 3 are similar to those reference characters denoting the same components of the steam generator system illustrated within FIG. 1 with the exception that the reference characters employed within FIGS. 2 and 3 are in a 100 series of numbers.

As a result of the interdisposition of the perforated flow distribution plate 100 between the lower free end or edge portion 202 of the steam generator tube bundle wrapper 146 and the upper surface 204 of the tube bundle tube sheet 122, the downcomer region 148 of the steam generator, within which incoming infeed water is flowing vertically downwardly as seen in the direction of arrow 206 between the steam generator outer shell 116 and the wrapper 146, is physically separated from the portion 208 of the steam generator which is radially internally or interiorly of the steam generator wrapper 146 and within which the heat exchanger U-shaped tubes 20 would be disposed, although the latter are not illustrated within FIG. 3. It is seen that the perforated flow distribution plate 100 comprises a plurality of main body portions or segments 210 within each of which there is defined a multitude of through-bores or apertures 212 which are uniformly distributed throughout each plate main body portion or segment 210 in an array which comprises diagonally extending rows, all as best seen in FIG. 2. In light of the foregoing structure, then, when the incoming infeed water flowing vertically downwardly in the direction of arrow 206 within the downcomer region 148 of the steam generator seeks to cross-over or traverse the region of the steam generator which is located directly beneath the lower free end or peripheral edge 202 of the tube bundle wrapper 146 so as to pass from the downcomer region 148 of the generator into the tube bundle section or region 208 of the generator, the water is forced to pass only through the through-bores or apertures 212 of the perforated flow distribution plate segments or sections 210. As can thus be appreciated from FIG. 3, therefore, uniform flow, exhibiting substantially parallel flow paths as designated by the arrows 214, is achieved through the perforated flow distribution plate segments or sections 210, and such flow is free from turbulent conditions which characterizes the flow within such regions of a steam generator within which the perforated flow distribution plate 100 of the present invention is not employed, such as, for example, as illustrated within FIG. 1. Viewing the flow conditions in a slightly different light or from a slightly different viewpoint, the disposition of the perforated flow distribution plate 100 within the transition zone 216 defined between the downcomer region 148 and the tube bundle region 208 serves to interrupt the fluidic communication between the downcomer and tube bundle regions 148 and 208, respectively, whereby the normal 180° flow path of the incoming infeed water 206, which serves to induce the turbulence and the generated or developed vortices, is in fact unable to establish or generate such vortices and turbulent flow conditions because such conventional 180° flow path has been effectively severed, and in lieu thereof, there has been established a plurality of substantially parallel flow paths as schematically illustrated by the arrows 214.

In addition to aforenoted structural features per se of the perforated flow distribution plate 100 of the present invention, and its particular disposition within the transition zone 216 of the steam generator, it is also of importance to appreciate the fact that the plate 100 likewise serves to drastically alter the flow velocity characteristics of the incoming infeed water flow 206. More particularly, the lower free end or peripheral edge portion 202 of the steam generator wrapper 146 is conventionally disposed above the upper surface 204 of the tube bundle tube sheet 122 a distance approximately between twelve and fourteen inches (12–14″), while the distance defined between the tube bundle wrapper 146 and the steam generator shell 116 is approximately two or three inches (2–3″). The fluid velocity of the incoming infeed water 206 flowing vertically downwardly within the downcomer region 148 is approximately fifteen feet per second (15 fps), and therefore, in view of the fact that there is an approximate factor of five defined between the fluid flow spaces between the wrapper lower edge-tube sheet upper surface and the shellwrapper, the flow velocity of the incoming or feed water through the transition zone or region 216 would normally be reduced by one-fifth so as to exhibit a speed of three feet per second (3 fps). In reality, however, the actual flow velocity is substantially higher, and on the order of eight or ten feet per second (8–10 fps) due to the turbulent conditions induced within the flow path. Continuing further, by the provision of the perforated flow distribution plate 100 of the present invention, wherein the same is provided with a porosity factor approximately fifty per cent (50%) by means of through-bores or apertures 212, a factor of two is introduced into the system, and consequently, the flow velocity of the water through the holes or apertures 212 within the perforated flow distribution plate 100 of the present invention is approximately six feet per second (6 fps). This compares quite favorably with the aforenoted velocity characteristic of the conventional steam generator system, and in addition, it is also to be emphasized, of course, that the resulting flow through the perforated flow distribution plate 100 of the present invention is uniform flow which is free of turbulence, vortices, and the like. Still further, in view of the uniform flow paths through the flow distribution plate 100 as schematically designated by the arrows 214, it has been experienced that the turbulent and vortex flow conditions which possibly occur within a conventional steam generator which does not employ the flow distribution plate 100 of the present invention do not in fact tend to be re-established or regenerated within the tube bundle region 208 of the generator. As a result of all of the foregoing, no substantial vibrational forces are induced upon the steam generator tube bundle tubes 20 whereby excessive wear of the tubes 20 is effectively prevented with a concomitant extension in the service life of the heat exchanger tubes 20. As an additionally desirable characteristic or feature of the flow distribution plate 100 of the present invention, each of the through-bores or apertures 212 has been predetermined so as to have a diametrical extent of approximately one-quarter inch (0.25″), and in this manner, foreign particles which may be entrained within the incoming infeed water 206, and having a diametrical size greater than one-quarter inch (0.25″) are prevented from entering the tube bundle section of the generator. In this manner, erosive degradation of the tubes 20 of the generator is minimized as a result of eliminating such particles from the tube bundle region 208 of the generator wherein such particles would normally impact and impinge upon the tubes 20.

With reference still being made to FIG. 3 of the drawings, it is seen that in order to provide for the installation of the perforated flow distribution plate 100 of the present invention in connection with, for example, already existing steam generator facilities, the upper edge of each perforated plate segment 210 is integrally provided with an upstanding flange portion 218 as well as a horizontally extending flange portion 220 such that the two flanged portions together define an L-shaped shoulder or seat for engagement with the lower free end or peripheral edge portion 202 of the generator wrapper 146. The primary or main body portions 210 of each perforated plate segment is seen to be inclined with respect to the horizontal through means of an angle $\alpha$ of approximately 80° , and consequently, when the plate segments 210 are wedgingly interposed between the upper surface 204 of the tube sheet 122 and the lower free peripheral edge portion 202 of the generator wrapper 146 such that the wrapper edge portions 202 is seated within the plate shoulder region as defined by means of the plate segment flanged portions 218 and 220, the inclined plate segments 210 will be disposed within a stable erected mode relative to the the generator wrapper 146 and the tube sheet 122, under the influence of the incoming infeed water 206, it being remembered that the perforated flow plate 100 of the present invention extends circumferentially about the entire lower end portion 202 of the wrapper 146.

In order to actually install the perforated flow distribution plate 100 of the present invention into existing steam generator facilities, an access must initially be made within the steam generator outer shell 116 so as to permit insertion of the individual plate segments 210 into the annular downcomer region 148 of the generator as well as to provide manipulative access to the segments 210 once the same are disposed within the downcomer region 148. If the generator vessel or shell 116 is conventionally provided with manipulative access passageways, such as, for example, that shown at 222 in FIG. 1, then such passageways may be employed for facilitating additional manipulation of the plate segments 210 within the downcomer region 148, provided that such access passageways are located at a suitable or proper elevational level with respect to the tube sheet 22 or 122, it being noted that such access passageways 222 are not conventionally large enough to permit the insertion of the plate segments 210 into the downcomer region 148. Once individual perforated flow distribution plate segments 210 are inserted through the access holes in the generator shell 116, adjacent segments may be securely fastened together either by means of welding techniques or by suitable brackets 224 provided upon the upper side edge of each plate segment, within or through which bolt fasteners 226 may be inserted. While such brackets 224 are illustrated as being employed only along the upper extent of each plate segment, it is understood that if such be desired, similar brackets and bolt fasteners may likewise be employed along the lower extent or edge of each of the segments 210 so as to maintain the abutting side edges of the segments 210 in close, sealed contact with each other. Upon completion of the welding or bolt fastening processing of, for example, the first two segments 210, the assembled plate segments 210 may be translated circumferentially within the transition zone 216 of the generator in order to accommodate the next plate segment 210 to be welded or bolt fastened to the preceding plate segments 210. It is to be understood that in view of the fact that the circumferential curvature of each of the plate segments 210 is similar to that of the generator wrapper 146, and in particular, the fact that the circumferential curvature of the plate flanged portions 218 and 220 are substantially identical to that of the wrapper so as to be operatively mated therewith, such circumferential translation of the segments within the transition zone 216 of the generator for accomplishing the installation of the entire plate 100 within the generator should not present any problems. Upon assembly together of all of the plate segments 210, and the disposition of the entire plate 100 about the lower periphery of the generator wrapper 146, the first and last two plate segments 210 may be welded or bolted together, however, it is noted that the segments 210 are not, and need not, be fixedly secured to the generator wrapper 146 within existing steam generator facilities. Such assembly processing or techniques not only permits the circumferential translation of the assembled segments about the transition zone 216 of the generator so as to accommodate additional segments for assembly thereof, but in addition, such foreshortens the requisite assembly time and any exposure of such assembly or maintenance personnel to radiation as a result of the core coolant having been conducted through the heat exchanger tube bundle tubes 20. Upon completion of the entire assembly operation, it is simply necessary to close the access hole originally made within the generator shell 116 so as to preserve the structural integrity of the shell and the generator.

In accordance with an alternative mode of installing the perforated flow distribution plate 100 of the present invention within the steam generator facility, access to the interior of the steam generator shell may be accomplished through means of maintenance or inspection manways conventionally provided within the steam dome chamber region 80 of the upper steam generator shell section 14 as shown in FIG. 1 at 228. The individual circumferentially curved or arcuate plate segments 210 may then be lowered vertically downwardly within the upper and transition zone sections 14 and 18 of the generator and ultimately passed downwardly into the downcomer region 148. The lower maintenance of personnel access or inspection manways 222 may then be utilized for performance of the actual installation, circumferential translation, and in-situ welding or bolt fastening operations in connection with the plate 100, if the manways 222 are suitably located elevationally with respect to the tube sheet 122. If the manways 222 are not suitably located, then access penetrations are again required to be made within the steam generator shell 116, however, these penetrations need not be as large as those required in accordance with the previous mode of installation for they do not have to provide for the insertion or introduction of the plate segments 210 into the generator. It is foreseeable that some difficulty might possibly be encountered in accordance with this mode of installation of the plate segments 210 into the generator in that the tapered transition zone annulus, as defined between the shell transition zone section 18 and the corresponding portion of the tube bundle wrapper, may not readily permit traversal therethrough of the circumferentially curved or arcuate-shaped plate segments 210, in which instance access penetrations, not shown, in the form of vertically extending grooves or the like, may have to be provided within the outer surface of the tube bundle wrapper. Lowering of the plate segments 210 from manways 228 to the tube sheet 122 or 22 may be accomplished by any suitable means, such as, for example, suspension cables, or the like.

In the instance of new steam generator facilities, the perforated flow distribution plate 100 of the present invention may simply be provided as an integral skirt portion of what otherwise would be the conventional tube bundle wrapper, and consequently, the foregoing installation requirements would no longer be required. It is noted that the tube bundle wrapper 146 is conventionally fabricated from a suitable carbon steel, however, in order to improve the erosive and corrosive resistivity of the perforated or foraminous flow distribution plate 100 of the present invention, it might be best to fabricate the same from a suitable metal, such as, for example, INCONEL 600 nickel-chromium alloy. This is particularly desirable in view of the fact that the plate 100 also serves to prevent the introduction of foreign particles, larger than the aforenoted predetermined size of one-quarter inch (0.25") in diameter, into the tube bundle region 208 of the generator. Long term testing in reference water chemistry has shown that plates having such through-holes defined therein do not experience any substantial tendency for erosion, sludge deposition, or the like, and the fabrication of the plate segments 210 from INCONEL 600 nickel-chromium alloy would enhance these operative and service life characteristics or properties still further. In the instance that the plate segments 210 are therefore fabricated from a different material than that of the wrapper 146, the plate segments 210 may be welded to the wrapper 146 prior to the installation of the wrapper 146 within the generator, or still alternatively, a one-piece perforated flow distribution plate skirt, fabricated of INCONEL 600 nickel-chromium alloy, may be welded or otherwise secured to the lower end of the wrapper 146 prior to installation of the same within the generator. It is of course to be understood that in connection with existing facilities, the plate segments 210 fabricated of INCONEL 600 nickel-chromium alloy would be installed in accordance with the aforenoted in-situ techniques, and not directly affixed or secured to the wrapper 146. The width of the individual plate segments 210 will be dictated by means of commercially availab1e strip dimensions, and the thickness of the plate segments 210 may be specified by means of suitable stress analyses, anticipated transient flow loads under, for example, fluid line rupture conditions, and the like.

Obviously, many modifications and variations of the present invention are possible in light of the above teachings. It is therefore to be understood that within the scope of the appended claims, the present invention may be practiced otherwise than as specifically described herein.

I claim:

1. A steam generator, comprising:

a plurality of heat exchange tubes through which a heated fluid flows;

a tube bundle tube sheet through which said heat exchange tubes pass;

a wrapper, having a lower free edge portion, disposed about said heat exchange tubes so as to define a heat exchange tube section interiorly of said wrapper;

an outer shell disposed substantially concentrically about said heat exchange tube wrapper so as to define a downcomer region between said outer shell and said heat exchange tube wrapper;

means for introducing water into said downcomer region of said steam generator for flow into into said heat exchange tube section so as to permit said water to undergo a heat exchange process with said heat exchange tubes and thereby be converted into steam; and means operatively associated with said heat exchange tube wrapper, interposed between the lower free edge portion of said wrapper and the upper surface of said tube bundle tube sheet, comprising a foraminous plate in the form of an annular ring having the configuration of a conical frustum for imparting to said water non-tubulent uniform flow conditions as said water flows from said downcomer region of said steam generator into said heat exchange tube section of said steam generator.

2. A steam generator as set forth in claim 1, wherein:

said foraminous plate is operatively associated with the lower end of said heat exchange tube wrapper.

3. A steam generator as set forth in claim 1, wherein:

said foraminous plate is in the form of a skirt operatively associated with the lower end of said heat exchange tube wrapper.

4. A steam generator as set forth in claim 1, wherein:

the porosity factor of said foraminous plate is approximately fifty percent (50%).

5. A steam generator as set forth in claim 1, further comprising:

a tubesheet within which the ends of said heat exchange tubes are disposed; and said foraminous plate is interposed between the lower end of said heat exchange tube wrapper and said tubesheet.

6. A steam generator as set forth in claim 1, wherein:

the angle of inclination of the side wall of said conical frustum is approximately 80° with respect to a horizontal plane.

7. A steam generator as set forth in claim 1, wherein:

said foraminous plate comprises a plurality of arcuate plate segments secured together so as to form said annular ring.

8. A steam generator as set forth in claim 7, wherein:

each of said foraminous plate segments is fabricated from INCONEL 600 nickel-chromium alloy.

9. A steam generator as set forth in claim 1, wherein:

said foraminous plate comprises a one-piece annulus fixedly secured to the lower end of said heat exchange tube wrapper.

10. A steam generator as set forth in claim 9, wherein:

said one-piece annulus is fabricated from INCONEL 600 nickel-chromium alloy.

11. A steam generator, as set forth in claim 1, wherein:

the apertures comprising said foraminous plate have a predetermined size so as to prevent foreign particles having a size greater than said predetermined size from entering said tube bundle section of said steam generator.

12. A steam generator as set forth in claim 11, wherein:

said predetermined size is approximately one-quarter inch (0.25") in diameter.

13. A steam generator, comprising:

a plurality of heat exchange tubes through which a heated fluid flows;

a tube bundle tube sheet through which said heat exchange tubes pass, a wrapper, having a lower free edge portion, disposed about said heat exchange tubes so as to define a heat exchange tube section interiorly of said wrapper;

an outer shell disposed substantially concentrically about said heat exchange tube wrapper so as to define a downcomer region between said outer shell and said heat exchange tube wrapper;

means for introducing water into said downcomer region of said steam generator for flow into said heat exchange tube section so as to permit said water to undergo a heat exchange process with said heat exchange tubes and thereby be converted into steam; and means operatively associated with said heat exchange tube wrapper, interposed between the lower free edge portion of said wrapper and the upper surface of said tube bundle tube sheet, comprising a foraminous plate in the form of an annular ring having the configuration of a conical frustrum, for preventing foreign particles of a predetermined size, and disposed within said water flowing through said downcomer region of said steam generator, from entering said heat exchange tube section of said steam generator.

14. A steam generator as set forth in claim 13, wherein:

the apertures comprising said foraminous plate are approximately one quarter inch (0.25") in diameter.

15. A steam generator as set forth in claim 13, wherein:

said foraminous plate comprises a plurality of arcuate segments secured together so as to form said annular ring.

16. A steam generator as set forth in claim 13, wherein:

said foraminous plate comprises a one-piece annulus fixedly secured to the lower end of said heat exchange tube wrapper.

17. A steam generator as set forth in claim 13, further comprising:

a tubesheet within which the ends of said heat exchange tubes are disposed; and said foraminous plate is interposed between the lower end of said heat exchange tube wrapper and said tubesheet.

* * * * *